US006820786B2

(12) United States Patent
Fleissner

(10) Patent No.: US 6,820,786 B2
(45) Date of Patent: Nov. 23, 2004

(54) METHOD AND DEVICE FOR TRANSPORTING A NONWOVEN MATERIAL BETWEEN TWO SEPARATED ROLLERS

(75) Inventor: Gerold Fleissner, Zug (DE)

(73) Assignee: Fleissner GmbH & Co Maschinenfabrik, Binzen (DE)

( * ) Notice: Subject to any disclaimer, the term of this patent is extended or adjusted under 35 U.S.C. 154(b) by 0 days.

(21) Appl. No.: 10/046,275

(22) Filed: Jan. 16, 2002

(65) Prior Publication Data

US 2002/0092884 A1 Jul. 18, 2002

(30) Foreign Application Priority Data

Jan. 16, 2001 (DE) ..... 101 05 843

(51) Int. Cl.[7] ..... B65H 20/12; B65H 20/10
(52) U.S. Cl. ..... 226/95; 226/170; 226/190
(58) Field of Search ..... 226/47, 170, 168, 226/183, 190

(56) References Cited

U.S. PATENT DOCUMENTS 4,668,322 A 5/1987 Christensen
5,614,303 A * 3/1997 Baigas, Jr. ..... 442/247
5,915,613 A * 6/1999 Meschenmoser ..... 226/95
6,050,469 A * 4/2000 Brabant et al. ..... 226/95 X
6,141,833 A 11/2000 Sorensen
6,253,983 B1 * 7/2001 Dadd ..... 226/95
6,308,878 B1 * 10/2001 Stahlecker ..... 226/170

FOREIGN PATENT DOCUMENTS

| | | |
|---|---|---|
| DE | 10008746 | 8/2001 |
| EP | 0032722 | 7/1981 |
| EP | 0899370 | 3/1999 |

* cited by examiner

*Primary Examiner*—Kathy Matecki
*Assistant Examiner*—Scott J. Haugland
(74) *Attorney, Agent, or Firm*—Antonelli, Terry, Stout & Kraus, LLP

(57) ABSTRACT

A not-yet-bonded or only slightly bonded nonwoven staple fiber material cannot be delivered from the nip of a calendar roller pair to a following endless conveyor without support during transport. To provide this support, the invention provides for a supporting rotating element such as an endless conveyor or perforated drum, either of which is designed to be permeated by air from below flowing toward the element. This feature simultaneously achieves a cooling effect.

6 Claims, 3 Drawing Sheets

METHOD AND DEVICE FOR TRANSPORTING A NONWOVEN MATERIAL BETWEEN TWO SEPARATED ROLLERS

BACKGROUND OF THE INVENTION

German Patent application DE-A-100 08 746 describes a continuous system in which the nonwoven staple fiber material produced on a carding machine runs through a calendar and then to an endless conveyor for further processing on which the carded nonwoven material is provided with a pulp coating and subsequently undergoes hydrodynamic needling. The nonwoven material must be cooled after calendaring, and to achieve this a pair of cooling rollers not referred to in the application must then be inserted between the calendar and the endless conveyor. In the event the nonwoven material is not bonded by the calendar roller pair, that is, in the event the calendar is traversed in the open state in the continuous system by the nonwoven material, the nonwoven staple fiber material is not strong enough to pass through the cooling roller pair or to the following endless conveyor without an effective support for its surface.

SUMMARY OF THE INVENTION

The goal of the invention is to develop a method and associated device by which a nonbonded, or light, nonwoven staple fiber material may be continuously and easily transported from the roller nip of the calendar roller pair to the continuing endless conveyor.

To achieve this goal, the invention provides that the nonwoven material be seized by air pressure, such as a partial vacuum, which acts against the transport element, and that it be held by this partial vacuum on the transport element during the transfer and delivery process. This partial vacuum may act on an endless delivery conveyor or on a perforated drum. It is especially advantageous if cooling air has already been passed through the nonwoven material during the required delivery.

BRIEF DESCRIPTION OF THE DRAWINGS

A schematic illustration of a corresponding device to implement the method is shown in the drawing. This drawing will be used to explain additional details of the invention.

DETAILED DESCRIPTION OF THE PREFERRED EMBODIMENTS

Figure 1:
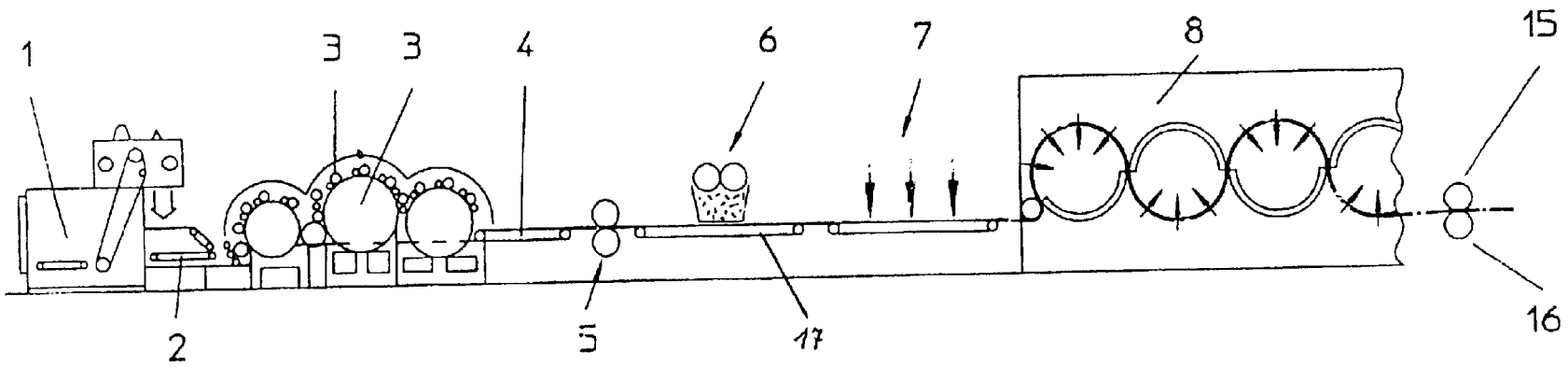
FIG. 1 shows a side view of a continuous system for producing a composite nonwoven material with only one carded nonwoven material as a carrier base.

As a first step, the nonwoven support material is produced from polyester fibers and/or polypropylene fibers or the like. A carding machine 1–4 functions here as the nonwoven material laying device. The carding machine includes a hopper feeder 1 with an oscillating chute 2 located under it which delivers the fibers of the carding machine, which have been uniformly distributed in a lateral dimension, by raising and toothed rollers 3. The following endless conveyor 4 delivers the laid carded nonwoven material to a calendaring unit 5 which here consists of a simple roller pair. The bonding effect should only be small here so as to then allow the pulp to undergo a more intimate bonding with the carded nonwoven material.

After this processing step, the fiber pulp is fed in the familiar fashion, for example, using a device 6 as described in European Patent Application EP-A-0 032 772. In the continuous system, an endless conveyor 17 is provided for this purpose which follows calendar roller pair 5. Both nonwoven layers together are bonded by undergoing hydrodynamic needling 7 which may be performed on the same endless conveyor 17. The next step is the drying process which occurs on a perforated drum unit 8 by through-air ventilation. In the device 6, the fan is located directly on the front side of the perforated drums. The final step is additional calendaring by roller pair 15, 16 but now at a higher energy level.

Figure 2:
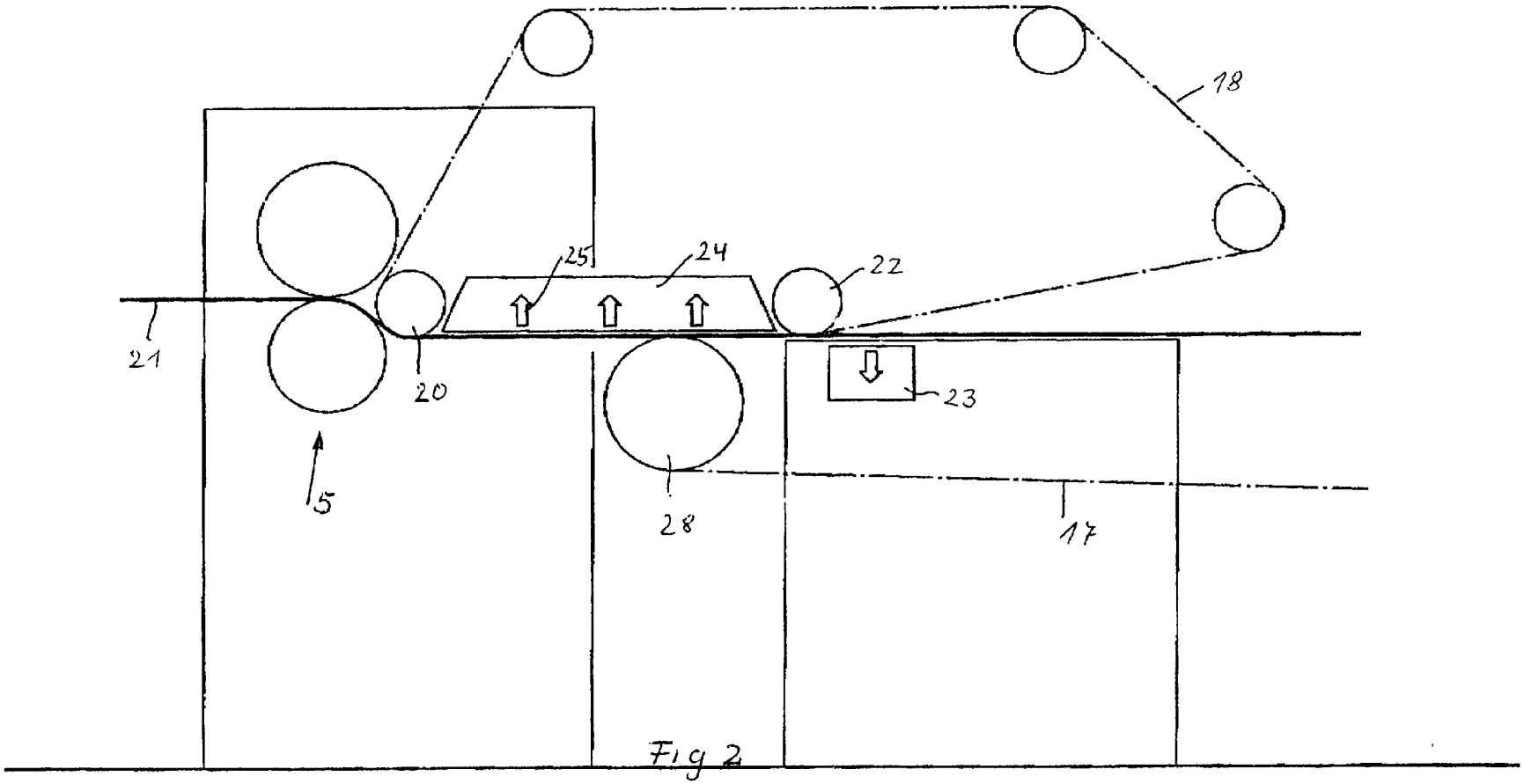
FIG. 2 shows an enlarged view of the delivery section from the calendar to the following endless conveyor.

A problematic area is the delivery of carded nonwoven material 21 from calendar 5 to endless conveyor 17. After calendaring, the nonwoven material 21 exhibits a certain strength which allows it to be transported into a cooling roller pair. However, calendaring may not always be desirable, or the strength may be insufficient even with calendaring. A remedy for this problem is shown in FIG. 2 where provision is made for delivering the nonwoven material 21 using an additional endless conveyor 18, or in FIG. 3 where a perforated drum 19 is provided with suction. Both of these solutions have the advantage that the otherwise necessary cooling roller pair can be eliminated.

In FIG. 2, endless delivery conveyor 18 is located above endless conveyor 17, the first deflection roller 20 of said conveyor 18 being engaged at the level of the nip between calendar rollers 5. This arrangement results in the nonwoven material 21 being in contact longer with the lower roller of calendar 5 but this is not disadvantageous. The return side of endless delivery roller 18 then continues horizontally and extends thus to running-off roller 22 which may be followed by a suction device 23 located below endless conveyor 17. Between deflection roller 20 and running-off roller 22, there is located a suction box 24 above the return side which pulls nonwoven material 21 against endless conveyor 18, thereby easily advancing the nonwoven material to endless conveyor 17. Nonwoven material 21 may be simultaneously permeated by cooling air 25 and be cooled after completion of calendaring.

Figure 3:
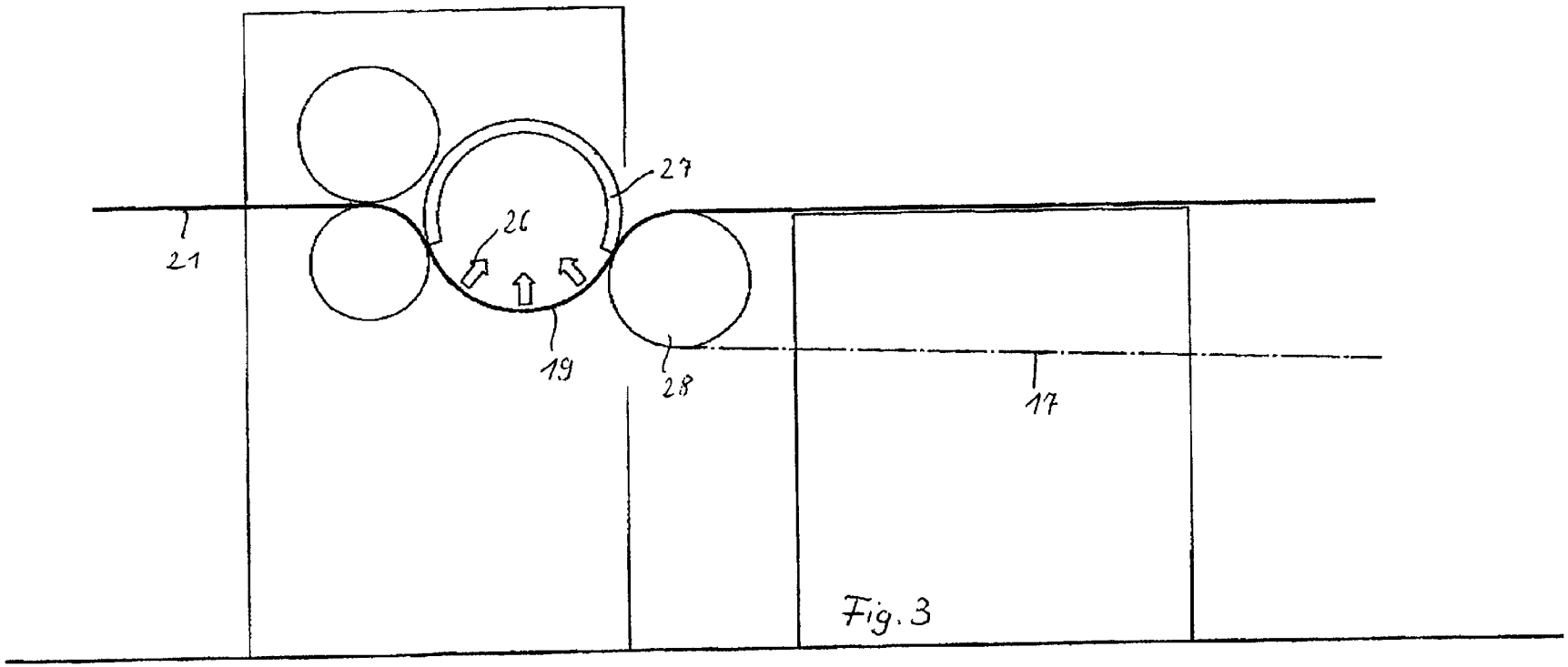
FIG. 3 shows the same section as seen in FIG. 2 with another embodiment of the delivery device.

In the device shown in FIG. 3, endless conveyor 18 is replaced by a perforated drum 19 which is subject to suction. Perforated drum 19 is arranged such that it transfers nonwoven material 21 in a meander-shaped track guider and then delivers it to endless conveyor 17. To achieve this, perforated drum 19 at its axis is located approximately at the level of the roller pair of calendar 5. Suction draft 26 ensures easy transport and delivery of nonwoven material 21 to endless conveyor 17. To achieve this, an inner cover 27 is provided which extends more than 180°, beginning at the delivery line of the nonwoven material to the perforated ending at the first deflection roller 28 of endless conveyor 17. The perforated drum 19 may be supplied, as required, with cooling air 26. During delivery, the nonwoven material 21 may be simultaneously processed and cooled at the intrinsic temperature of the nonwoven material 21.

What is claimed is:

1. A device comprising:

a pressing roller pair having a roller nip through which only an unbonded nonwoven material passes;

an adjacent roller downstream of the pressing roller pair for further transport of the nonwoven material; and a perforated drum provided between the pressing roller pair and the adjacent roller, the perforated drum having an inner cover provided on a top side of the perforated drum and otherwise being subject to a partial vacuum, the inner cover extending over more than 180° and beginning directly above a delivery line of the nonwoven material from the pressing roller pair and ending directly above a delivery line of the nonwoven material to the adjacent roller, and the perforated drum being engaged with the roller nip of the pressing roller pair such that the nonwoven material partially encircles a lower roller of the pressing roller pair.

2. Device according to claim 1, characterized in that the perforated drum is supplied, as required, with cooling air.

3. Device according to claim 1, characterized in that the pressing roller pair is a calender roller pair and the adjacent roller is encircled by a following endless conveyor for further processing, and in that the endless circulating transport device is a counter-rotating perforated drum associated with a lower roller of the calender roller pair, in which drum a partial vacuum is generated.

4. Device according to claim 3, characterized in that cooling air in the form of ambient air is fed to the perforated drum.

5. Device according to claim 1, characterized in that the pressing roller pair is a calender roller pair.

6. Device according to claim 5, characterized in that the calender roller pair does not completely bond the nonwoven material.

* * * * *